US007316875B2

(12) United States Patent
Iftime et al.

(10) Patent No.: US 7,316,875 B2
(45) Date of Patent: Jan. 8, 2008

(54) PHOTOCHROMIC PAPER WITH IMPROVED BISTABILITY

(75) Inventors: Gabriel Iftime, Mississauga (CA); Peter M. Kazmaier, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 271 days.

(21) Appl. No.: 11/123,163

(22) Filed: May 6, 2005

(65) Prior Publication Data

US 2006/0251988 A1 Nov. 9, 2006

(51) Int. Cl.

| | |
|---|---|
| ***G03C 1/50*** | (2006.01) |
| ***G03C 1/66*** | (2006.01) |
| ***G03C 1/67*** | (2006.01) |
| ***G03C 1/685*** | (2006.01) |
| ***G03C 1/735*** | (2006.01) |

(52) U.S. Cl. ..... 430/19; 430/337; 430/338; 430/341; 430/345; 430/962

(58) Field of Classification Search ..... 430/19, 430/338, 341, 345, 337, 962

See application file for complete search history.

(56) References Cited

U.S. PATENT DOCUMENTS

| | | | | |
|---|---|---|---|---|
| 3,510,308 | A * | 5/1970 | Foris et al. | 430/333 |
| 3,519,635 | A * | 7/1970 | Breitner et al. | 252/600 |
| 4,184,874 | A * | 1/1980 | Takeda | 430/236 |
| 4,725,527 | A * | 2/1988 | Robillard | 430/339 |
| 5,053,320 | A * | 10/1991 | Robillard | 430/339 |
| 5,288,592 | A * | 2/1994 | Miyashita | 430/345 |
| 6,365,312 | B1 * | 4/2002 | Foucher et al. | 430/108.21 |

OTHER PUBLICATIONS

Wojtyk et al., "Effects of metal ion complexation on the spiropyran-merocyanine interconversion: development of a thermally stable photo-switch," J. Chem. Soc. Chem, Comm., pp. 1703-1704, 1998.

* cited by examiner

*Primary Examiner*—Richard L. Schilling
(74) *Attorney, Agent, or Firm*—Oliff & Berridge, PLC

(57) ABSTRACT

An image forming medium including at least a polymer and a photochromic compound such as spiropyran embedded in the polymer, wherein spiropyran molecules of the spiropyran compound are chelated by a cation.

21 Claims, 2 Drawing Sheets

PHOTOCHROMIC PAPER WITH IMPROVED BISTABILITY

BACKGROUND

Transient documents and photochromic paper for transient documents have already been reported in U.S. patent application Ser. No. 10/835,518 and U.S. patent application Ser. No. 10/834,722, where images printed on photochromic paper can be read for a few hours under room light conditions, and the transient documents self-erase with no effort from the user and are ready to be printed again with new images the next day. The resulting blank sheet of paper is ready to be printed again with new information, and the paper may be reusable many times. Although there are other available technologies such as liquid crystals, electrophoretics, or gyricon for providing transient documents, none of these technologies can provide a document that really feels like paper.

A different application for photochromic based media is for reimageable documents such as, for example, electronic paper documents. Reimageable documents require information to be kept for as long as the user wants, then the information can be erased or the reimageable document can be re-imaged using an imaging system with different information. Written images on electronic paper may be readable for longer period of time such as, for example, many days or weeks.

Buncel et al. (J. T. C. Wojtyk, P. M. Kazmaier, E. Buncel. *J. Chem. Soc. Chem. Comm.* 1703, (1998)) reported lifetimes of at least several days for solutions in acetone of spiropyrans modified with chelating groups in the presence of metallic cations. As shown in Equation 1 below, the metal cation $M^{n+}$ can stabilize the open merocyanine form through chelation. For comparison, a classical spiropyran molecule, containing no chelating groups, is stable in its colored form for only a few minutes.

SUMMARY

It is sometimes desirable that an image formed on a medium remains stable for a longer period of time than just a few hours. This is the envisioned use for electronic paper documents. Electronic paper documents should maintain a written image for as long as the user needs to view it. The image may then be erased or changed with a different one by the user on command. Classical photochromic materials in solid state media such as, for example, in polymeric binders, are stable for only a few hours. In order to be of use for electronic paper documents as defined above, the colored state needs to be stable for at least several days in solid-state media.

It was found that a normal spiropyran material has a significantly longer time stability of several hours of the opened isomer, which denotes the colored state, under room light temperature when placed in a solid-state device, compared to the same in solution, which stability lasts for several minutes only. Similarly, it is expected that a system that is stable for days in solution such as, for example, chelated spiropyran systems, will be stable for much longer time in solid state. Accordingly, electronic paper, which keeps a written image for long time, may keep the printed information on it for several weeks, until it needs to be printed with new text or images.

In light of the above described problems and shortcomings, various exemplary embodiments of the systems and methods provide an image forming medium that includes a polymer and a spiropyran compound embedded in the polymer, wherein spiropyran molecules of the spiropyran compound are chelated by a cation. Moreover, various exemplary implementations of the methods provide a method of manufacturing an image forming medium that includes dissolving an amount of spiropyran in a solution, adding a salt to the solution, mixing the solution, providing a substrate, providing a layer of the mixed solution on a first surface of the substrate, drying the substrate, and providing a white or opaque background on a second surface of the substrate opposite the first surface. For practical utilization the photochromic system needs to be in a solid state phase, and the chelated spiropyrans are adapted to the fabrication of a polymeric solid state media.

BRIEF DESCRIPTION OF THE DRAWINGS

Various exemplary embodiments of the systems and methods will be described in detail, with reference to the following figures, wherein.

DETAILED DESCRIPTION OF EMBODIMENTS

Figure 1:
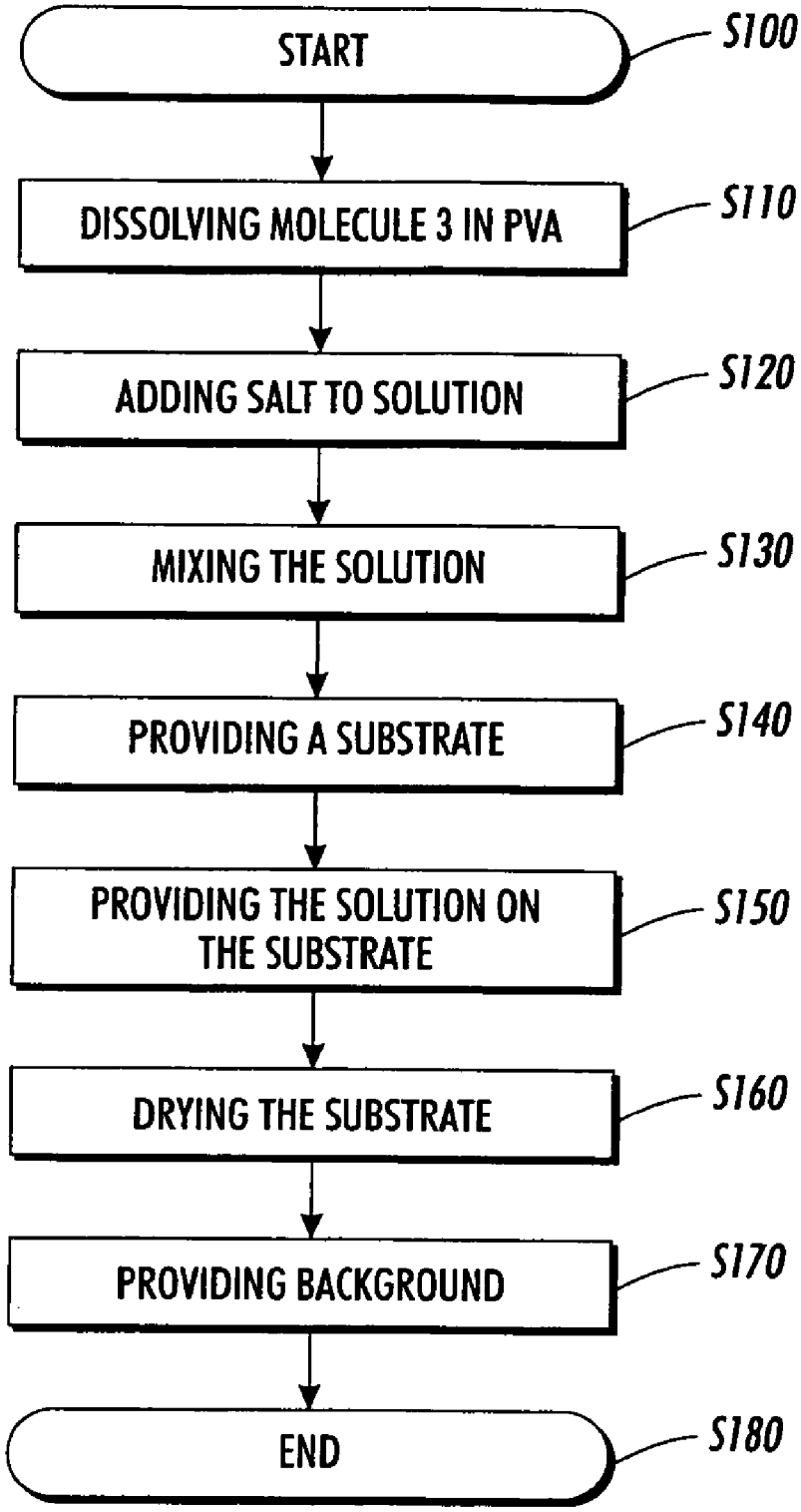
FIG. 1 is a flow chart illustrating an exemplary method of manufacturing an image forming medium using a water based approach.

These and other features and advantages are described in, or are apparent from, the following detailed description of various exemplary systems and methods.

Generally, in various exemplary embodiments, there is provided a photochromic paper formed using a photochromic material, such as a spiropyran, modified with a chelating group. Incorporation of the chelating group may provide for longer times of color contrast between the image and background areas of the photochromic paper.

The photochromic material useful in the photochromic paper may be a chelating photochromic compound, which is a molecular structure consisting of a photochromic moiety and a chelating group, linked by a connector W, as shown in Formula 1 below. The structure illustrated in Formula 1 below represents a photochromic material possessing a chelating group.

(1)

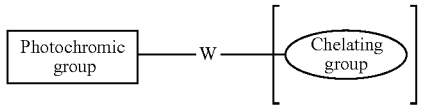

The role of the W group is to connect the photochromic moiety, responsible for photochromic effect with the chelating group, responsible for chelating with metal ions and as a result, stabilization of the colored state of the photochromic compound. According to various exemplary embodiments, W may be a bond, an atom such as, for example, S, O, N, a linear or branched alkyl diaradical, like for example ($—CH_2—CH_2—CH_2—$), an aryl or arylalkyl group, an ester group, and the like.

As described in more detail below, the photochromic group may be any suitable photochromic material that is useful in providing photochromic paper such as, for example, organic photochromic materials. Such useful photochromic materials include, but are not limited to, spiropyrans and related compounds like spirooxazines and thiospiropyrans, benzo and naphthopyrans (chromenes), stilbene, azobenzenes, bisimidazols, spirodihydroindolizines, quinines, perimidinespirocyclohexadienones, viologens, fulgides, fulgimides, diarylethenes, hydrazines, anils, aryl thiosulfonates and the like, as illustrated below. Also, the chelating group may be attached at any of the available positions of the photochromic group through the connecting group W.

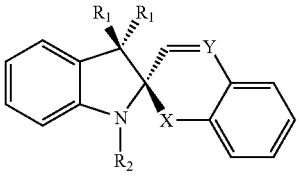

Spiropyran (X = O; Y = —CH)
Spiooxazine (X = O; Y = N)
Thiospiropyran (X = S; Y = CH)

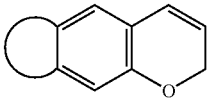

Benzo and Naphtopyran
(Chromene)

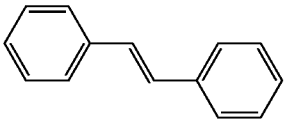

Stilbene

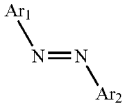

Azobenzene

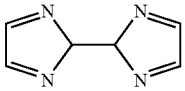

Bisimidazol

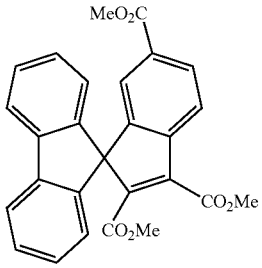

Spirodihydroindolizines

-continued

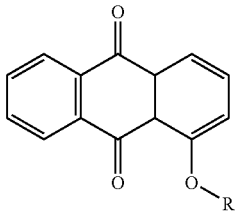

Quinone

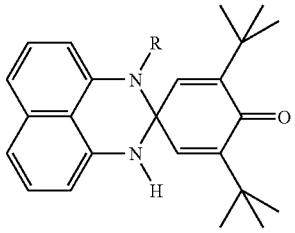

Perimidinespirocyclohexadienones

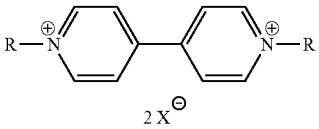

Viologen

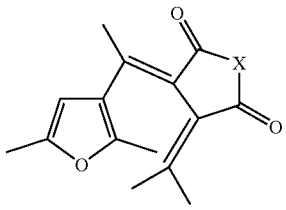

Fulgides (X = O)
Fulgimides (X = NR)

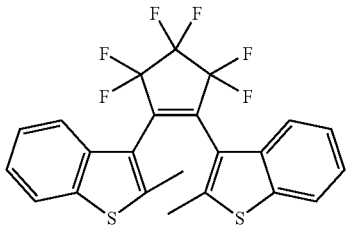

Diarylethenes

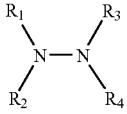

Hydrazines

-continued

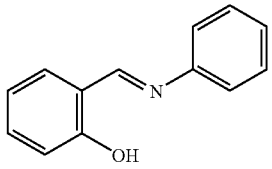

Anil

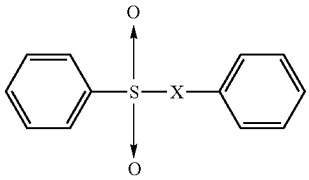

Aryl thiosulfonates

Particularly preferred are the spiropyrans and related compounds, although any material may be used as long as the material provides the desired color contrast properties.

The photochromic material may be modified to include one or more chelating groups that may subsequently assist in the incorporation of the metal ion. For example, the photochromic material may be modified to include a carboxylic acid group that acts as chelating group. Other chelating groups are functional groups capable of coordinating a metal ion. Examples of chelating froups include, but are not limited to, primary ($NH_2$), secondary ($NHR_1$) and tertiary amino $NR_1R_2$) groups, ester group (—$COOR_1$), hydroxyl (—OH), ether group (—$OR_1$) heteroaromatic groups like pyridyl, sulfonic acid, ketones, thioalcohols (—SH), thioether (—$OSR_1$) where the $R_1$, $R_2$ groups may be a linear or branched alkyl group, a cycloalkyl or an aryl group which may be further substituted with other functional groups. Such modifications may be readily incorporated into the photochromic material, as is known in the art and apparent from the instant disclosure.

According to various exemplary implementations, the metal ion $M^{n+}$ is provided by an inorganic salt. The metal ion chelates to the chelating group of the photochromic chelating material, which may provide enhanced stability of the colored state of the photochromic group. The inorganic salt may be a salt of mono, di, tri or higher valency metal ions. Metal salts, such as, for example, NaCl, NaBr, $MgCl_2$, $CaCl_2$, $CaBr_2$, or transition metal salts such as, for example, $ZnCl_2$, $ZnBr_2$, $ZnI_2$, $NiCl_2$, AgCl, $CuF_2$, CuBr, $CuBr_2$ are suitable for chelating the photochromic compound. Coordination transition metal complexes are also suitable. Examples of such salts include $ZnCl_2[(CH_3)_2N—CH_2CH_2—N(CH_3)_2]$, $Zn(OOC—CH_3)_2$, $Zn(acrylate)_2$, Zinc(cycloheylybutyrate)$_2$, Copper(II)(gluconate)$_2$, Copper(II)(acetylacetonate)$_2$, Zn(acetylacetonate)$_2$, Zn(hexafluoroacetylacetonate)$_2$, Copper(II)(nitrate)$_2$ and, the like.

In order to incorporate the chelating photochromic material and the metal ion into a photochromic paper, the chelating photochromic material may be provided in the solid state, as dispersed in a polymeric binder. As such, the chelating photochromic material and the metal ion may be uniformly dispersed in a polymeric binder or, if desired, the chelating photochromic material and the metal ion may be non-uniformly dispersed to provide particular desired final products. For example, the chelating photochromic material and the metal ion may be uniformly dispersed in the polymeric binder to provide a uniform imageable area on the photochromic paper. Alternatively, if desired, the chelating photochromic material and the metal ion may be non-uniformly dispersed in the polymeric binder, such as to provide areas of low or no imageability such as, for example, borders and the like.

Any suitable polymeric binder may be used, as desired. For example, suitable examples of polymeric binders include, but are not limited to, polymethylmethacrylate (PMMA), polycarbonates, polystyrenes, polysulfones, polyethersulfones, polyarylsulfones, polyarylethers, polyolefins, polyacrylates, polyvinyl derivatives, cellulose derivatives, polyurethanes, polyamides, polyimides, polyesters, silicone resins, epoxy resins, polyvinyl alcohol, polyacrylic acid and the like. Copolymer materials such as polystyrene-acrylonitrile, polyethylene-acrylate, vinylidenechloride-vinylchloride, vinylacetate-vinylidene chloride, styrene-alkyd resins are also examples of suitable binder materials. The copolymers may be block, random, or alternating copolymers.

The photochromic paper may comprise a supporting substrate, coated on at least one side with the photochromic material. According to various exemplary embodiments, the supporting substrate may be coated on both sides with the photochromic material. When the photochromic material is coated on both sides, or when higher visibility of the image is desired, an opaque layer may be included between the supporting substrate and the photochromic material layer or on the opposite side of the supporting substrate from the coated photochromic material layer. Thus, for example, if a one-sided photochromic paper is desired, the photochromic paper may include a supporting substrate, coated on one side with the photochromic material and coated on the other side with an opaque layer such as, for example, a white layer. Also, the photochromic paper may include a supporting substrate, coated on one side with the photochromic material and with an opaque layer there between. If a two-sided photochromic paper is desired, then the photochromic paper may include a supporting substrate, coated on both sides with the photochromic material layer, and with at least one opaque layer interposed between the two coated photochromic material layers. Of course, an opaque supporting substrate may be used in place of a separate supporting substrate and opaque layer, if desired.

Any suitable supporting substrate may be used, as desired. For example, suitable examples of supporting substrates include, but are not limited to, wood, plastics, paper, fabrics, textile products, polymeric films, inorganic substrates such as metals, and the like. The plastic may be for example a plastic film, such as polyethylene film, polyethylene terepthalate, polyethylene napthalate, polystyrene, polycarbonate, polyethersulfone. The paper may be, for example, plain paper such as XEROX® 4024 paper, ruled notebook paper, bond paper, silica coated papers such as Sharp Company silica coated paper, Jujo paper, and the like. The substrate may be a single layer or multi-layer where each layer is the same or different material. The substrate has a thickness ranging for example from about 0.3 mm to about 5 mm.

When an opaque layer is used in the photochromic paper, any suitable material may be used. For example, where a white paper-like appearance is desired, the opaque layer may be formed from a thin coating of titanium dioxide, or other suitable material like zinc oxide, inorganic carbonates.

For example, following is a diagram illustrating the stabilization of the merocyanine isomer by chelation with metal ions.

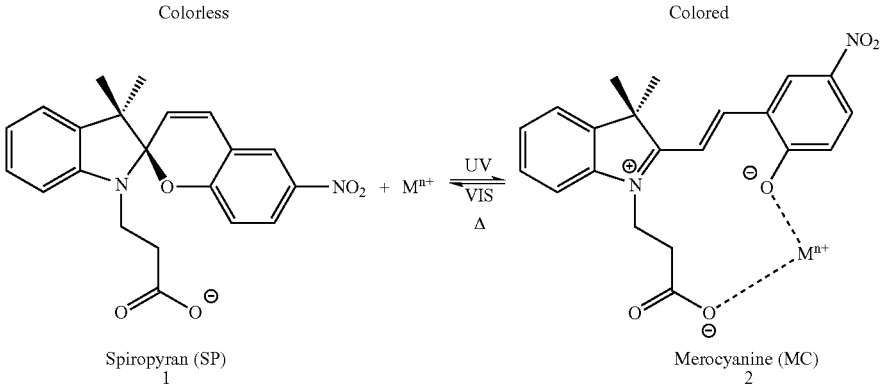

$M^{n+}$ represents the metal ion capable of being chelated by the chelating group present on the photochromic compound. Because n is an integer, the chelating group may be present in the spiropyran illustrated above as Molecule 1.

The spiropyran may be modified by incorporation of a carboxylic acid group, which assists the formation of the chelate, 6-nitro-N-(2-carboxyethyl)-spiropyran (Molecule 3 below), below is such a spiropyran modified with a carboxylic acid group that is efficient in stabilizing merocyanine isomer when chelated with metal cations.

3

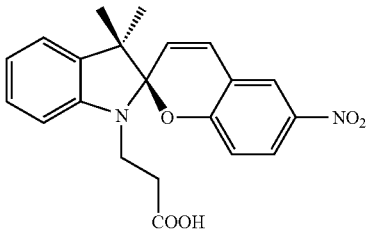

According to various exemplary embodiments, the photochromic material changes its color from colorless to colored state when illuminated with UV light. The document may then be erased by heating or by illumination with visible light of an appropriate wavelength.

To erase the temporary image from photochromic paper, the temporary image may be subjected to an indoor ambient condition for an image erasing time in order to change the color contrast to the absence of color contrast. Thus, the temporary image is erased without using an image erasure device or technique, and the temporary image is visible only for a period of time sufficient for a user to view the temporary image, but the period of time is also limited in order to allow the user to repeat the procedures of temporary image formation and temporary image erasure a number of times. As such, the medium may undergo a number of cycles of temporary image formation and temporary image erasure. Accordingly, the re-imageable medium may be considered "self-erasing."

The imaging light may have any suitable predetermined wavelength scope such as, for example, a single wavelength or a band of wavelengths. In various exemplary embodiments, the imaging light is an ultraviolet (UV) light having a single wavelength or a narrow band of wavelengths selected from the UV light wavelength range of about 200 nm to about 475 mm, particularly a single wavelength at about 365 nm or a wavelength band of about 360 nm to about 370 nm. For each temporary image, the reimageable medium may be exposed to the imaging light for a time period ranging from about 10 milliseconds to about 5 minutes, particularly from about 30 milliseconds to about 1 minute. The imaging light may have an intensity ranging from about 0.1 $mW/cm^2$ to about 100 $mW/cm^2$, particularly from about 0.5 $mW/cm^2$ to about 10 $mW/cm^2$.

In various exemplary embodiments, imaging light corresponding to the predetermined image may be generated for example by a computer on a Light Emitting Diode (LED) array screen and the temporary image is formed on the reimageable medium by placing the medium on the LED screen for the preferred period of time. In other exemplary embodiments, a UV Raster Output Scanner (ROS) may be used to generate UV light.

According to various exemplary implementations, the color contrast that renders the temporary image visible to an observer may be a contrast between, for example two, three or more different colors. The term "color" may encompass a number of aspects such as hue, lightness and saturation, where one color may be different from another color if the two colors differ in at least one aspect. For example, two colors having the same hue and saturation but are different in lightness would be considered different colors. Any suitable colors such as, for example, red, white, black, gray, yellow and purple, can be used to produce a color contrast as long as the temporary image is visible to the naked eye of a user. In various exemplary embodiments, the following exemplary color contrasts may be used: purple temporary image on a white background; yellow temporary image on a white background; dark purple temporary image on a light purple background; and light purple temporary image on a dark purple background.

In various exemplary embodiments, the color contrast may change such as, for example, diminish during the visible time, but the phrase "color contrast" may encompass any degree of color contrast sufficient to render a temporary image discernable to a user regardless of whether the color contrast changes or is constant during the visible time.

In various exemplary embodiments, the color contrast of the temporary image on the photochromic paper may be maintained for a period of time of at least several hours, such as, for example, at least four hours, preferably at least six or at least eight hours, and even more preferably for at least twelve or at least twenty-four hours. In order to enable its use as long-term electronic paper, the color contrast of the temporary image on the photochromic paper in embodiments may be maintained for a period of time of at least two days or at least four days, and more preferably at least one week or at least two weeks.

In various exemplary embodiments, erasure of the temporary image may occur by any of the following: (i) changing the color of the region exposed to the imaging light to the color of the region not exposed to the imaging light; (ii) changing the color of the non-exposed region to the color of the exposed region; or (iii) changing the color of the exposed region and the color of the non-exposed region to the same color different from both the exposed region color and the non-exposed region color.

The photochromic material may exhibit photochromism, which is a reversible transformation of a chemical species induced in one or both directions by absorption of an electromagnetic radiation between two forms having different absorption spectra. The first form is thermodynamically stable and may be induced by absorption of light to convert to a second form. The reverse reaction from the second form to the first form may occur, for example, thermally, or by absorption of light. Various exemplary embodiments of the photochromic material may also encompass the reversible transformation of the chemical species among three or more forms in the event it is possible that reversible transformation occurs among more than two forms. The photochromic material may be composed of one, two, three or more different types of photochromic materials, where the term "type" refers to each family of reversibly interconvertible forms such as, for example, spiropyran and its isomer merocyanine collectively forming one type (also referred to as one family) of photochromic material. Unless otherwise noted, the term "photochromic material" refers to all molecules of the photochromic material regardless of form. For example, where the photochromic material is of a single type such as spiropyran/merocyanine, at any given moment the molecules of the photochromic material may be entirely spiropyran, entirely merocyanine, or a mixture of spiropyran and merocyanine. In various exemplary embodiments, for each type of photochromic material, one form may be colorless or weakly colored and the other form may be differently colored.

In various exemplary embodiments, the photochromic material may be thermochromic and exhibit thermochromism, which is a thermally induced reversible color change.

Any suitable photochromic material may be used such as, for example, an organic photochromic material. Examples of suitable photochromic materials may include compounds that undergo heterocyclic cleavage, such as spiropyrans and related compounds; compounds that undergo homocyclic cleavage such as hydrazine and aryl disulfide compounds; compounds that undergo cis-trans isomerization such as azo compounds, stilbene compounds and the like; compounds that undergo proton or group transfer phototautomerism such as photochromic quinines; compounds that undergo photochromism via electro transfer such as viologens and the like; and others.

Suitable examples of the photochromic material may include spiropyrans compounds and analogue compounds of the general formulas (the closed form may be colorless/weakly colored; the open form may be differently colored):

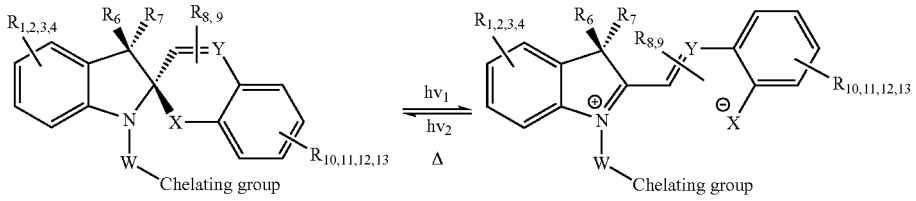

Closed form (Spiropyran when X = O and Y = CH) Open form (Merocyanine when X = O and Y = CH)

According to various exemplary embodiments, in the above diagrams, $R_1$, $R_2$, $R_3$, $R_4$, $R_6$, $R_7$, $R_8$, $R_9$, $R_{10}$, $R_{11}$, $R_{12}$ and $R_{13}$ each, independently of the others may be (but are not limited to) hydrogen, alkyl, including cyclic alkyl groups, such as cyclopropyl, cyclohexyl, and the like, and including unsaturated alkyl groups, such as vinyl ($H_2C{=}CH{-}$), allyl ($H_2C{=}CH{-}CH_2{-}$), propynyl ($HC{\equiv}C{-}CH_2{-}$), and the like, preferably with from 1 to about 50 carbon atoms and more preferably with from 1 to about 30 carbon atoms, aryl, preferably with from about 6 to about 30 carbon atoms and more preferably with from about 6 to about 20 carbon atoms, arylalkyl, preferably with from about 7 to about 50 carbon atoms and more preferably with from about 7 to about 30 carbon atoms, silyl groups, nitro groups, cyano groups, halide atoms, such as fluoride, chloride, bromide, iodide, and astatide, amine groups, including primary, secondary, and tertiary amines, hydroxy groups, alkoxy groups, preferably with from 1 to about 50 carbon atoms and more preferably with from 1 to about 30 carbon atoms, aryloxy groups, preferably with from about 6 to about 30 carbon atoms and more preferably with from about 6 to about 20 carbon atoms, alkylthio groups, preferably with from 1 to about 50 carbon atoms and more preferably with from 1 to about 30 carbon atoms, arylthio groups, preferably with from about 6 to about 30 carbon atoms and more preferably with from about 6 to about 20 carbon atoms, aldehyde groups, ketone groups, ester groups, amide groups, carboxylic acid groups, sulfonic acid groups, and the like. The alkyl, aryl, and arylalkyl groups can also be substituted with groups such as, for example, silyl groups, nitro groups, cyano groups, halide atoms, such as fluoride, chloride, bromide, iodide, and astatide, amine groups, including primary, secondary, and tertiary amines, hydroxy groups, alkoxy groups, preferably with from 1 to about 20 carbon atoms and more preferably with from 1 to about 10 carbon atoms, aryloxy groups, preferably with from about 6 to about 20 carbon atoms and more preferably with from about 6 to about 10 carbon atoms, alkylthio groups, preferably with from 1 to about 20 carbon atoms and more preferably with from 1 to about 10 carbon atoms, arylthio groups, preferably with from about 6 to about 20 carbon atoms and more preferably with from about 6 to about 10 carbon atoms, aldehyde groups, ketone groups, ester groups, amide groups, carboxylic acid groups, sulfonic acid groups, and the like.

Further, two or more R groups (that is, $R_1$ through $R_{13}$) can be joined together to form a ring.

According to various exemplary embodiments, the chelating group may be a carboxylic acid, primary ($NH_2$), secondary ($NHR_1$) and tertiary amino $NR_1R_2$) groups, ester group (—$COOR_1$),hydroxyl (—OH), ether group (—$OR_1$) heteroaromatic groups like pyridyl, sulfonic acid, ketones, thioalcohols (—SH), thioether (—$OSR_1$) where the $R_1$, $R_2$ groups may be a linear or branched alkyl group, a cycloalkyl or an aryl group which may be further substituted with other functional groups.

X may be Oxygen atom (O) or Sulphur atom (S). Y may be CH group, Nitrogen atom (N) or Phosphorus atom (P). Compounds with X═O and Y═CH, are known as spiropyrans. In this case, the closed form isomer is known as spiropyran compound, while the open form isomer is known as merocyanine compound. Compounds with X═O and Y═N, are known as spiroxazines. Compounds with X═S and Y═CH are known as spirothiopyrans.

According to various exemplary implementations, manufacturing a solid state re-imageable medium may be performed via at least two approaches: i) a water based approach, and ii) an organic solvent approach. Other approaches and modifications are also possible.

In the water based approach, the photochromic material may be dissolved in a solvent that is both water miscible and a good solvent for organic materials so as to ensure the solubility of the photochromic material. According to various exemplary embodiments, the solution is then mixed and a salt may be added to the solution. A film may then be made by spreading the solution on a side of a plastic or a paper substrate, and the film may be dried. Also, a background may be coated on the other side of the substrate.

FIG. 1 is a flow chart illustrating an exemplary method of manufacturing an image forming medium using a water based approach. According to various exemplary embodiments, the method starts in Step S100, and continues to step S110, during which an amount of 6-nitro-N-(2-carboxyethyl)-spiropyran, a photochromic compound, may be dissolved in solution. According to various exemplary implementations, 0.10 g of 6-nitro-N-(2-carboxyethyl)-spiropyran may be dissolved in a solution of Polyvinyl Alcohol (PVA) 10% in distilled water containing 2-5% Ethanol. The ethanol, which is water miscible and a good solvent for organic materials, ensures complete solubility of the photochromic compound in the mixture of solvents. Next, control continues to step S120, during which an amount of inorganic salt $ZnCl_2$ may be added to the solution. According to various exemplary implementations, the inorganic salt $ZnCl_2$ may be added as solid to the composition and the amount of salt may be adjusted from less than one equivalent to 20 equivalents with regard to the photochromic compound. Next, control continues to step S130, during which the solution is mixed.

Next, control continues to step S140, during which a substrate that may be plastic or paper is provided. Next, control continues to step S150, during which a film of the solution is provided on the substrate. According to various implementations, the film may be made with a blade on the plastic or paper substrate. Next, control continues to step S160, during which the film may be dried overnight in an oven at a temperature of about 50° C. to 70° C. Next, control continues to step S170, during which a white background may be coated on the other side of the film. Alternatively, a sheet of white paper may be soaked in the previously prepared solution and may be dried first at room temperature for a few hours, then in the oven for a few additional hours. Next, control continues to step S180, where the method ends.

In the organic solvent approach, the photochromic material may be dissolved in an organic solvent that is capable of ensuring solubility of both the photochromic material and any inorganic salt that may need to be added to the solution. Once the photochromic material and the inorganic salt are dissolved, a polymer may be added and is also dissolved in the solution. According to various exemplary embodiments, a solid state solution may then be fabricated by film coating with, for example, a blade, on a substrate, or by soaking paper in the solution.

Figure 2:
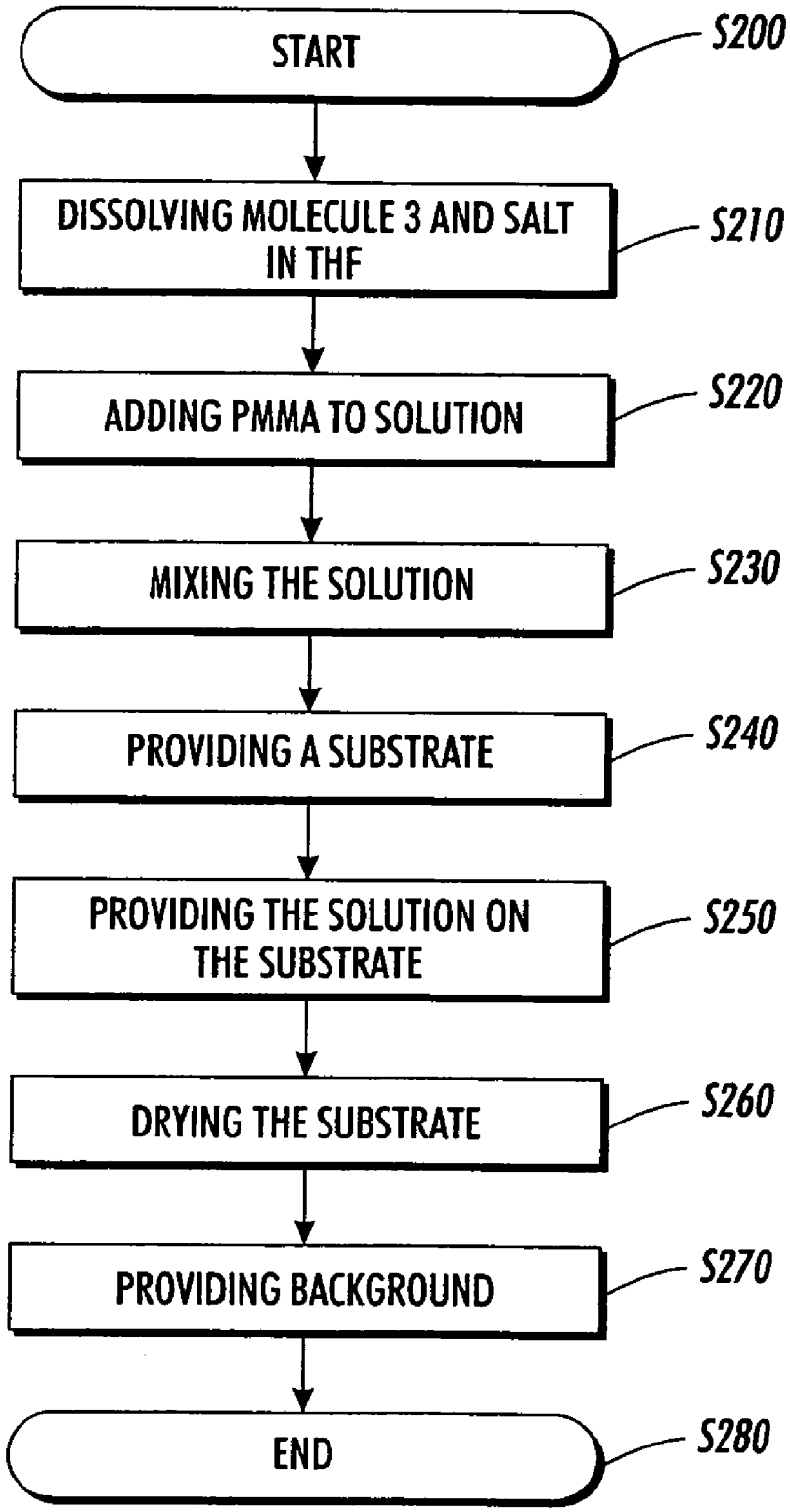
FIG. 2 is a flow chart illustrating an exemplary method of manufacturing an image forming medium.

FIG. 2 is a flow chart illustrating an exemplary method of manufacturing an image forming medium. According to various exemplary embodiments, the method starts in step S200, and continues to step S210, where an amount of molecule 2 is dissolved in a tetrahydrofuran (THF) solution or a dioxane solution. According to various exemplary embodiments, 0.10 g of 6-nitro-N-(2-carboxyethyl)-spiropyran may be dissolved in a tetrahydrofuran (THF) solution containing approximately 1M $ZnCl_2$. It should be noted that dioxane may be used instead of THF as a solvent. Next, control continues to step S220, where Polymethylmethacrylate (PMMA) is added to this solution. Next, control continues to step S230, where the solution is stirred until the polymer is dissolved. According to various exemplary embodiments, the polymer may be PMMA. Next, control continues to step S240, where a substrate that may be plastic or paper is provided. Next, control continues to step S250, where a film of the solution is provided on the substrate. According to various implementations, the film may be made with a blade on the plastic or paper substrate. Next, control continues to step S260, during which the film may be dried overnight in an oven at a temperature of about 50° C. to 70° C. Next, control continues to step S270, during which a white background may be coated on the other side of the film. Alternatively, a sheet of white paper may be soaked in the previously prepared solution and may be dried first at room temperature for a few hours, then in the oven for a few additional hours. Next, control continues to step S280, where the method ends.

It will be appreciated that variants of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art which are also intended to be encompassed by the following claims.

What is claimed is:

1. An image forming medium, comprising a polymer; and a photochromic compound containing chelating groups embedded in the polymer; and a metal salt; wherein molecules of the photochromic compound are chelated by a metal ion from the metal salt;

wherein the photochromic compound comprises at least one of a spiropyran compound, spirooxazine, thiospiropyran, a benzo compound, naphthopyran, stilbene, azobenzene, bisimidazol, spirodihydroindolizine, quinine, perimidinespirocyclohexadienone, viologen, fulgide, fulgimide, diarylethene, hydrazine, anil, and aryl thiosulfonate;

wherein the chelating group is at least one of carboxylic acid, primary, secondary and tertiary amino groups, ester groups, hydroxyl, ether groups, heteroaromatic groups, sulfonic acid, ketone, thioalcohol, and thioether; and wherein the image forming medium further comprises at least one salt of a metal with an oxidation state of +1 or +3.

2. The image forming medium of claim 1, wherein the polymer comprises at least one of PMMA, polycarbonates, polystyrenes, polysulfones, polyethersulfones, polyarylsulfones, polyarylethers, polyolefins, polyacrylates, polyvinyl derivatives, cellulose derivatives, polyurethanes, polyamides, polyimides, polyesters, silicone resins, epoxy resins, polyvinyl alcohol, and polyacrylic acid.

3. The image forming medium of claim 1, wherein a stability of the image forming medium is at least several days.

4. The image forming medium of claim 1, wherein the image forming medium further comprises at least one of $ZnCl_2[(CH_3)_2N—CH_2CH_2—N(CH_3)_2]$, $Zn(OOC—CH_3)_2$, $Zn(acrylate)_2$, $Zinc(cycloheylybutyrate)_2$, $Copper(II)(gluconate)_2$, $Copper(II)(acetylacetonate)_2$, $Zn(acetylacetonate)_2$, $Zn(hexafluoroacetylacetonate)_2$, and $Copper(II)(nitrate)_2$.

5. The image forming medium of claim 1, wherein the salt is at least one of NaCl, NaBr, AgCl and CoBr.

6. The image forming medium of claim 1, further comprising a substrate, wherein the photochromic compound and the polymer are provided on at least one of a single surface of the substrate and both surfaces of the substrate.

7. A method of manufacturing an image forming medium, comprising:

dissolving an amount of a photochromic compound, which contains chelating groups, in a solvent;

adding a salt, which chelates the photochromic compound, to the solvent;

adding a polymer to the solvent; and mixing the solvent until the photochromic compound and the polymer are dissolved in the solvent;

wherein the photochromic compound comprises at least one of a spiropyran compound, spirooxazine, thiospiropyran, a benzo compound, naphthopyran, stilbene, azobenzene, bisimidazol, spirodihydroindolizine, quinine, perimidinespirocyclohexadienone, viologen, fulgide, fulgimide, diarylethene, hydrazine, anil, and aryl thiosulfonate;

wherein the chelating group is at least one of carboxylic acid, primary, secondary and tertiary amino groups, ester groups, hydroxyl, ether groups, heteroaromatic groups, sulfonic acid, ketone, thioalcohol, and thioether; and wherein the image forming medium further comprises at least one of NaCl, NaBr, AgCl, CoBr, $CoCl_3$, $AlCl_3$, and $VBr_3$.

8. A method of manufacturing an image forming medium, comprising:

dissolving an amount of a photochromic compound, which contains chelating groups, in a solvent;

adding a salt, which chelates the photochromic compound, to the solvent;

adding a polymer to the solvent; and mixing the solvent until the photochromic compound and the polymer are dissolved in the solvent;

providing a substrate;

providing a layer of the mixed solvent on a first surface of the substrate;

drying the substrate;

providing a background on a second surface of the substrate opposite the first surface; and wherein the photochromic compound comprises at least one of a spiropyran compound, spirooxazine, thiospiropyran, a benzo compound, naphthopyran, stilbene, azobenzene, bisimidazol, spirodihydroindolizine, quinine, perimidinespirocyclohexadienone, viologen, fulgide, fulgimide, diarylethene, hydrazine, anil, and aryl thiosulfonate; and wherein the chelating group is at least one of carboxylic acid, primary, secondary and tertiary amino groups, ester groups, hydroxyl, ether groups, heteroaromatic groups, sulfonic acid, ketone, thioalcohol, and thioether.

9. The method of claim 7, wherein the solvent comprises approximately 10% polyvinyl alcohol and approximately 2-5% ethanol in distilled water.

10. The method of claim 7, wherein the solvent comprises THF, PMMA and at least one of approximately 1M $ZnCl_2$, approximately 1M $ZnBr_2$, approximately 1M $MgCl_2$, and approximately 1M $ZnI_2$.

11. The method of claim 8, wherein the image forming medium further comprises at least one of NaCl, NaBr, AgCl, and CoBr.

12. The method of claim 8, wherein the image forming medium further comprises at least one of $ZnCl_2$, $MgCl_2$, $ZnBr_2$ and $ZnI_2$, $CuCl_2$, and $NiCl_2$.

13. The method of claim 8, wherein the image forming medium further comprises at least one of $CoCl_3$, $AlCl_3$, and $VBr_3$.

14. The method of claim 8, wherein the image forming medium further comprises at least one of $ZnCl_2[(CH_3)_2N—CH_2CH_2—N(CH_3)_2]$, $Zn(OOC—CH_3)_2$, $Zn(acrylate)_2$, $Zinc(cycloheylybutyrate)_2$, $Copper(II)(gluconate)_2$, $Copper(II)(acetylacetonate)_2$, $Zn(acetylacetonate)_2$, $Zn(hexafluoroacetylacetonate)_2$, and $Copper(II)(nitrate)_2$.

15. The method of claim 8, wherein the substrate comprises at least one of a plastic substrate and a paper substrate.

16. The method of claim 8, wherein providing a layer of the mixed solution on a first surface of the substrate comprises spreading the mixed solution on the first surface of the substrate with a blade.

17. The method of claim 8, wherein drying the substrate comprises leaving the substrate in an oven overnight at approximately 50-70° C.

18. The method of claim 8, wherein drying the substrate comprises:

soaking a sheet of paper in the solution;

drying the sheet at room temperature for several hours; and drying the sheet in an oven for several hours at approximately 50-70° C.

19. The method of claim 8, further comprising providing a layer of the mixed solution on the second surface of the substrate.

20. A method of forming a transient image, comprising:

providing the image forming medium of claim 1; and exposing the image forming medium to a UV light in an imagewise manner.

21. The image forming medium of claim 1, wherein the salt is at least one of $CoCl_3$, $AlCl_3$ and $VBr_3$.

* * * * *